US007029083B2

(12) United States Patent
Merz et al.

(10) Patent No.: US 7,029,083 B2
(45) Date of Patent: Apr. 18, 2006

(54) SYSTEMS AND METHODS FOR CONTROLLABLY REFILLING A FLUID QUANTITY SENSING FLUID EJECTION HEAD

(75) Inventors: Eric A. Merz, Palmyra, NY (US); Brian S. Hilton, Rochester, NY (US)

(73) Assignee: Fuji Xerox Co., Ltd., Tokyo (JP)

( * ) Notice: Subject to any disclaimer, the term of this patent is extended or adjusted under 35 U.S.C. 154(b) by 182 days.

(21) Appl. No.: 10/721,275

(22) Filed: Nov. 26, 2003

(65) Prior Publication Data

US 2005/0110815 A1 May 26, 2005

(51) Int. Cl.
*B41J 2/195* (2006.01)
*B41J 2/175* (2006.01)

(52) U.S. Cl. ..... 347/7; 347/85

(58) Field of Classification Search ..... 347/7, 347/85

See application file for complete search history.

(56) References Cited

U.S. PATENT DOCUMENTS 3,648,521 A 3/1972 Amendolia
5,231,534 A 7/1993 Kato
5,616,929 A 4/1997 Hara
5,997,121 A 12/1999 Altfather et al.
6,137,503 A 10/2000 Hashimoto et al.
6,173,609 B1 1/2001 Modlin et al.
6,447,084 B1 * 9/2002 Uetsuki et al. ..... 347/7
6,520,612 B1 2/2003 Merz et al.
6,796,627 B1 9/2004 Kimura et al.

OTHER PUBLICATIONS

U.S. Appl. No. 10/455,357, filed Jun. 6, 2003, Merz et al.

* cited by examiner

*Primary Examiner*—Shih-Wen Hsieh
(74) *Attorney, Agent, or Firm*—Oliff & Berridge, PLC

(57) ABSTRACT

A controller for a fluid ejecting system having a refillable container includes an ejection count initializing circuit, routine or application, a count incrementing circuit, routine or application, at least one fluid level indicator, and a fluid quantity circuit, routine or application for determining an expended quantity of fluid, a fluid reserve capacity circuit, routine or application for determining a fluid reserve capacity in the container, an ejection job determining circuit, routine or application for determining a fluid job requirement, a reserve comparing circuit, routine or application to compare the fluid reserve capacity and the fluid job requirement, and a refill condition determining circuit, routine or application to determine that the container is to be refilled. Counts for a ejection amount and a reserve capacity are incremented in response to a specific amount of fluid being ejected from the container. The expended quantity of fluid is based on the ejection amount count subsequent to the fluid level being indicated. The fluid reserve capacity is based on the reserve capacity count and the expended quantity of fluid. The fluid job requirement is based on the expended quantity of fluid and a job number of ejected amounts of fluid. The container is determined to be refilled upon at least a condition wherein the fluid job requirement exceeds the fluid reserve capacity, and a condition wherein the fluid level is below a refill threshold.

15 Claims, 6 Drawing Sheets

REFILL IF $(n-1)\,FF + FR < FN \leq nFF$

WAIT IF $nFF < FN \leq nFF + FR$

SYSTEMS AND METHODS FOR CONTROLLABLY REFILLING A FLUID QUANTITY SENSING FLUID EJECTION HEAD

BACKGROUND OF THE INVENTION

1. Field of Invention

This invention relates to controlling fluid quantity in a fluid ejection head.

2. Description of Related Art

Fluid ejector systems, such as drop-on-demand liquid ink printers, have at least one fluid ejector from which droplets of fluid are ejected towards a receiving sheet. For example, scanning inkjet printers are equipped with printheads containing fluid ink. The fluid is applied to a sheet in an arrangement based on print data received from a computer, a scanner or similar device. To control the delivery of the fluid to the sheet, fluid ejection heads are moved across the sheet to provide the fluid to the sheet, which is ejected as drops. Each drop corresponds to a liquid volume designated as a pixel. Each pixel is related to a quantity needed to darken or cover a particular unit area.

In order to lower cost and improve performance by limiting inertia, moving-head fluid ejection systems are designed with low-weight fluid ejection heads. In order to minimize weight, the fluid ejection heads contain a relatively small quantity of fluid. Consequently, the fluid ejection heads (or their fluid reservoirs) must either be periodically replaced or refilled. Replaceable cartridges are commonly used in home-use printers. Some heavier-use printers in industry attach the fluid ejector via an umbilical tube to a larger tank for continuous refilling. Other heavier-use printers periodically refill the fluid ejection head.

SUMMARY OF THE INVENTION

Replacing cartridges requires frequent interaction by the user, and is considered disadvantageous for fluid ejectors used in volume production or connected by a network to the ejection data source. Umbilical systems can be expensive, requiring pressurization, tubing, tube harness dressing, and can suffer performance degradation from moisture loss, pressure fluctuations due to acceleration or temperature variation, and motion hysterisis from tubing harness drag.

Periodic refill systems commonly do not accurately meter the fluid that is deposited into the fluid ejector. Consequently, the fluid reservoir in a fluid ejector must be significantly underfilled in order to avoid excess fluid spilling out of the refilled fluid reservoir. Consequently, this under-filling wastes space and reduces the productivity of the fluid ejection device due to the greater frequency of refill operations.

Accordingly, containers for consumable fluids in various applications of fluid ejection may require sensing fluid level to effectively refill or replace the fluid in a fluid reservoir. Such applications include, but are not limited to ink-jet printers, fuel cells, dispensing medication, pharmaceuticals, photo results and the like onto a receiving medium, injecting reducing agents into engine exhaust to control emissions, draining condensation during refrigeration, etc.

An improved method of monitoring and controlling fluid quantity would be desirable to determine when a fluid refill operation is appropriate.

This invention provides devices and methods for controlling a fluid ejector having a refillable container to determine that the container is to be refilled.

This invention separately provides devices and methods for initializing counts, and incrementing counts in response a specific amount of fluid being ejected from the container.

This invention separately provides devices and methods for indicating at least one fluid level in the container.

This invention separately provides devices and methods for determining an expended quantity of fluid released from the container, a fluid reserve capacity, and a fluid job requirement.

In various exemplary embodiments, a method for controllably refilling a fluid ejector having a refillable container usable to contain fluid, the fluid ejector ejecting fluid from the refillable container in response to ejection data contained in an ejection job includes determining first and second numbers of fluid ejection events that remain and are needed to complete the ejection job, and refilling the refillable container if a first or second condition is satisfied. The first condition is satisfied when the second number of fluid ejection events greater than the first number of fluid ejection events. The second condition is satisfied when the first number of fluid ejection events remaining is at most zero.

In various exemplary embodiments, the method provides delaying the refilling of the refillable container if the first condition is satisfied until the second condition is also satisfied when the second number of fluid ejection events is greater than a third number of fluid ejection events available after refilling the refillable container, and is less than a sum of the first number of fluid ejection events plus the third number of fluid ejector events. The third number of ejection events represents the capacity of the refillable container to provide fluid for a fluid ejection events after refilling the refillable container.

In various exemplary embodiments, the method provides initializing a sense interval count and a reserve capacity count and incrementing a reserve capacity count in response to a specific amount of fluid being ejected from the container.

In various exemplary embodiments, the method provides comparing a fluid reserve capacity to an indicated fluid level. In various exemplary embodiments, the indicated fluid level is a refill threshold level.

In various exemplary embodiments, the method provides for basing each fluid ejection event on a single ejection from the fluid ejector. In various exemplary embodiments, the method provides for basing each fluid ejection event on a particular number of single ejections from the fluid ejector.

In various exemplary embodiments, the method provides sensing a temperature corresponding to the fluid ejector temperature, and modifying instructions to the fluid ejector in response to the sensed temperature exceeding a temperature threshold.

In various exemplary embodiments, a control system for a fluid ejector includes a refill condition determining circuit, routine or application that determines whether the container is to be refilled in response to a particular condition being satisfied. In various exemplary embodiments, this condition includes the fluid job requirement exceeding the fluid reserve capacity. In various exemplary embodiments, this condition includes the fluid level descending below a refill threshold.

In various exemplary embodiments, the control system for a fluid ejector includes a fluid ejection determining circuit, routine or application that determines an expended quantity of fluid released from the container in response to an occurrence of a number of fluid ejection events and the determined fluid level, a fluid reserve determining circuit, routine or application that determines a fluid reserve capacity and the fluid job requirement, and a refill condition determining circuit, routine or application that determines that the container is to be refilled upon at least one of a first condition where the fluid job requirement exceeds the fluid reserve capacity and a second condition where the fluid level is below a refill threshold.

In various exemplary embodiments, the control system provides a count initializing circuit, routine or application that initializes at least one of an ejection event count and a reserve capacity count and a count incrementing circuit, routine or application that adjusts at least one of the ejection event count and the reserve capacity count in response to a specific amount of fluid being ejected from the container.

In various exemplary embodiments, the control system provides a temperature sensing circuit, routine or application corresponding to the fluid ejector temperature and a signal determining circuit, routine or application to determine that instructions to the fluid ejector are be modified upon a sensed temperature exceeds a temperature threshold.

In various exemplary embodiments, the control system provides a fluid level indicating circuit, routine or application that is usable with at least one fluid level indicator to determine at least one fluid level in the container. In various exemplary embodiments, the control system provides a reserve capacity determining circuit, routine or application that determines a fluid reserve capacity in the container based on the reserve capacity count and the expended quantity of fluid, a fluid job requirement circuit, routine or application that determines a fluid amount required to complete a current job based on the expended quantity of fluid and a number of fluid ejection events for the job, and a reserve comparing circuit, routine or application that compares the fluid reserve capacity and the fluid job requirement.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of the devices, systems and methods of this invention will be described in detail with reference to the following figures, wherein.

DETAILED DESCRIPTION OF EXEMPLARY EMBODIMENTS

The following detailed description of various exemplary embodiments of the fluid ejection systems according to this invention may refer to one specific type of fluid ejection system, e.g., an inkjet printer, for sake of clarity and familiarity. However, it should be appreciated that the principles of this invention, as outlined and/or discussed below, can be equally applied to any known or later-developed fluid ejection systems, beyond the fluid jet printer specifically discussed herein.

A fluid ejector, such as, for example, an inkjet printhead, is produced, distributed and/or installed with a fluid reservoir, such as, for example, an ink reservoir, typically filled with a fluid, such as, for example, ink. The fluid ejector, includes, in accordance with this invention, instrumentation to measure fluid level of the fluid that the fluid reservoir holds. One exemplary device usable to indicate the fluid level is a prism into which light is projected. The injected light is either reflected or absorbed depending on the presence or absence of the fluid at the level of the prism., as discussed in co-pending U.S. patent application Ser. No. 10/455,357, which is incorporated herein by reference in its entirety. With a plurality of prisms distributed over several levels, the quantity of the fluid remaining in the fluid reservoir can be monitored. Of course, it should be appreciated that other appropriate instruments can be used without departing from the scope of the invention.

Figure 1:
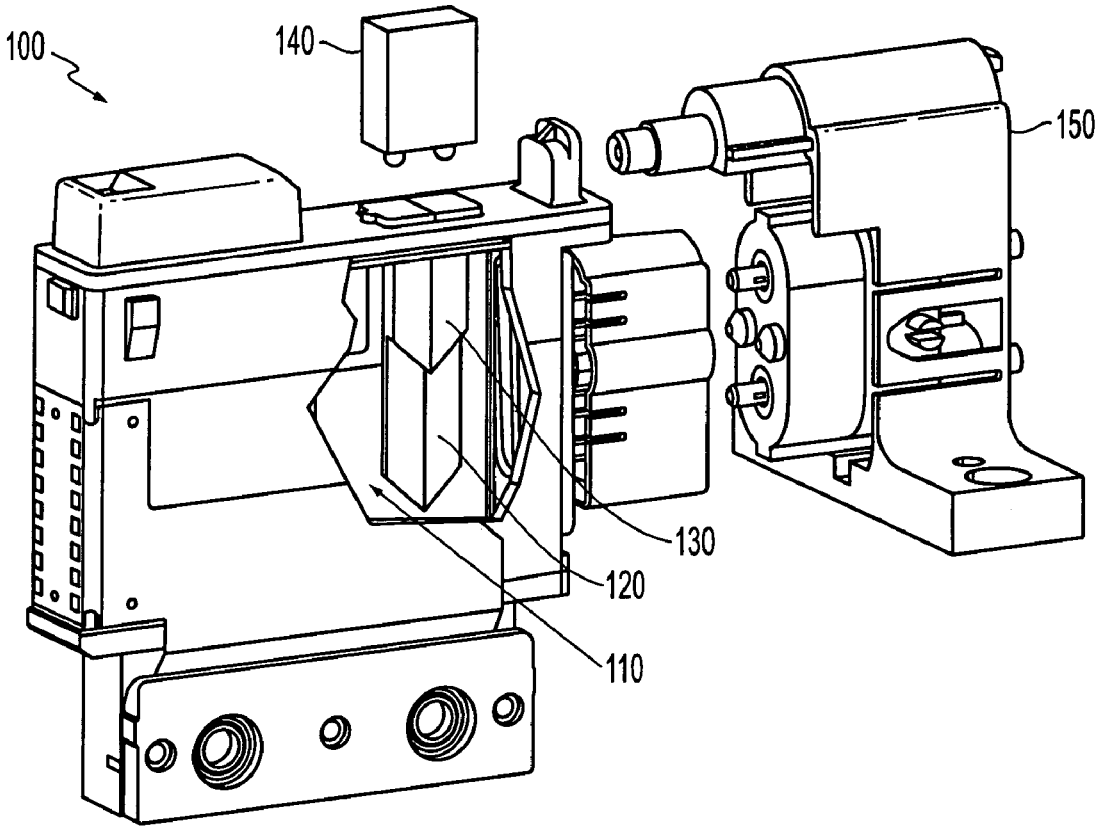
FIG. 1 is an isometric view of an exemplary embodiment of a fluid refill system usable with fluid level sensors.

FIG. 1 shows a fluid ejection head 100 usable with a fluid refill system according to this invention. As shown in FIG. 1, the fluid ejection head 100 includes the refillable fluid container or reservoir 110 with sensor systems 120 and 130 and a detector 140. The fluid reservoir 110 of the fluid ejection head 100 can be connected to a refill station 150 when the detector 140 detects, for example, that the fluid level in the fluid reservoir 110 has fallen below the lower prism 120. Subsequently, the fluid reservoir 110 of the fluid ejection head 100 can be disconnected from the refill station 150 when the detector 140 detects that the level in the fluid reservoir 110 has risen to, for example, a position above the upper prism 130.

In various exemplary embodiments, the fluid ejector includes a calibration measurement instrument, such as upper and lower threshold prisms. As manufactured, the fluid ejector contains a full quantity of fluid. The fluid is expended by the fluid ejector ejecting a quantity of the fluid that corresponds to a pixel on a sheet that receives the fluid. These ejecting commands can be counted by incrementing an initial count for each ejected quantity of fluid or for a number of such ejection events. Once the fluid remaining in the fluid reservoir has been reduced so that the indicated fluid level falls below the lower threshold prisms, the fluid quantity (by volume) between upper and lower threshold levels can be divided by the number of the fluid printing ejections counted to determine the volume of the fluid ejected per pixel or fluid ejecting command for that fluid ejector.

A sensor feedback prism that is permanently dry, i.e., that is not exposed to the fluid, can be used to aid in determining the fluid level. A prism sensor senses whether a prism is within the fluid, as described in more detail in the incorporated '357 application. The sensor feedback prism establishes a permanent condition of absence to the fluid that can be sensed by the prism sensor. The prism sensor compares sensor input from the sensor feedback prism to input from the upper and/or lower threshold prisms to determine whether the fluid level has fallen below the upper and/or lower threshold prisms.

While the fluid ejector may be normally understood to eject an anticipated quantity of fluid, such as ink, per pixel (i.e., per ejecting command) based on a production design, a manufacturing variation from unit-to-unit can cause the fluid to be depleted from the fluid reservoir at a faster or slower rate than the nominal amount. In addition, the fluid volume can vary with changes in fluid temperature and/or pressure. The determined volume of the fluid ejected per pixel based on the threshold prism can adjust this nominal value to provide more accurate prediction of the fluid depletion rate and for a refill schedule for the fluid reservoir.

In various exemplary embodiments, the fluid quantity in the fluid reservoir in the fluid ejector can be monitored by counting the number of pixels or fluid ejecting commands, and determining the remaining or reserve fluid capacity for subsequent ejection jobs. The reserve fluid capacity can be further compared to an ejection job based on the expected job size (e.g., number of pages or estimated pixels of the job), in order to determine whether to refill the fluid reservoir before commencing that next ejection job. The accuracy of this determination can be improved by measuring the fluid level and recalculating the fluid reserve capacity after each ejection job, after a number of ejection jobs, after a refill operation or after a number of refill operations.

Upon receiving a signal for a next ejection job and a signal indicating the number of pixels for that next ejection job, a volume of the fluid needed to complete that ejection job can be determined as a needed job volume. The fluid reserve volume within the fluid reservoir can be calculated based the count of pixels since the last measurement or the last time the fluid reservoir was refilled. If the fluid reserve volume exceeds the needed job volume, the job can be completed without needing to refill the fluid reservoir. Otherwise, the fluid ejector or fluid reservoir would be transferred to a refill station for refilling the fluid reservoir before beginning that next ejection job. The quantity of the fluid in the fluid ejector reservoir would then be reset to the refill level.

Figure 2:
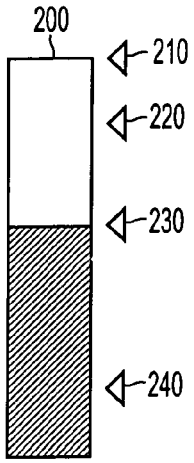
FIGS. 2–9 are fluid level diagrams representing fluid level conditions as provided in an exemplary embodiment according to this invention.

FIGS. 2–9 are fluid level diagrams representing fluid level conditions for a fluid reservoir, as provided for one exemplary embodiment. FIG. 2 shows a fluid reservoir 200 having an installation level of fluid 210, a "high" or full level of fluid 220, as indicated by a high level indicator, a level of remaining fluid 230 after several fluid ejecting commands, and a "low" level 240, as indicated by a low level indicator for triggering a refill operation.

Figure 3:
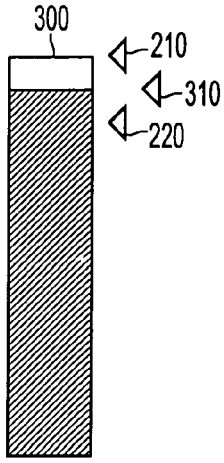

FIG. 3 shows a fluid reservoir 300 after some fluid ejecting commands with a level of remaining fluid 310 situated between the initialization level 210 and the high level 220.

Figure 4:
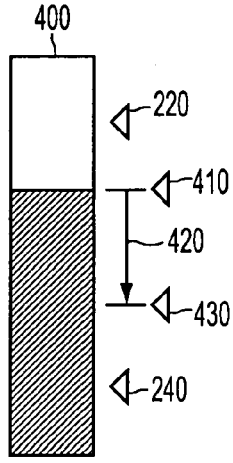

FIG. 4 shows a fluid reservoir 400 having a present fluid level 410 situated between the high level 220 and the low level 240. A current job has projected fluid consumption represented by fluid level change 420. At the completion of the current job, the future fluid level 430 will be between the present fluid level 410 and the low level 240. Thus, the fluid reservoir 400 will not need to be refilled during execution of the current job.

Figure 5:
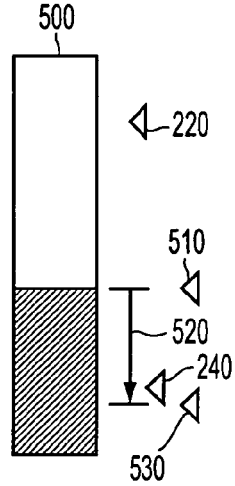

FIG. 5 shows a fluid reservoir 500 having a present fluid level 510 situated between the high level 220 and the low level 240. The current job has projected fluid consumption represented by fluid level change 520. At the completion of the current job, the future fluid level 530 will be below the low level 240. If the current job does not exceed the remaining fluid capacity, a refill operation for the reservoir 500 can be deferred until after completion of the current job.

Figure 6:
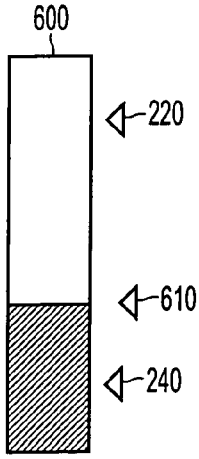

FIG. 6 shows a fluid reservoir 600 having a present fluid level 610 at the completion of the current job between the high level 220 and the low level 240. With no future jobs in queue, the fluid reservoir 600 need not be refilled.

Figure 7:
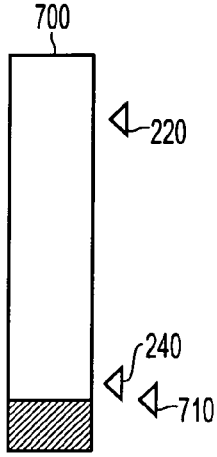

FIG. 7 shows a fluid reservoir 700 having a present fluid level 710 at the completion of the current job. The present fluid level 710 is below the low level 240. Even in the absence of future jobs in the queue, a refill operation is needed for the fluid reservoir 700.

Figure 8:
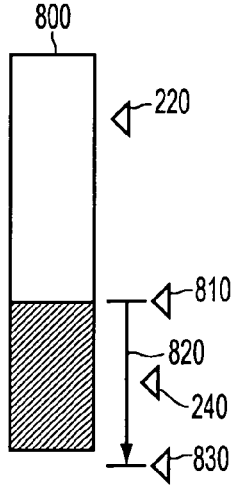

FIG. 8 shows a fluid reservoir 800 having a present fluid level 810 situated between the high level 220 and the low level 240 at the completion of the current job. A next job has a projected fluid consumption represented by a large fluid level change 820 that exceeds the remaining fluid in the fluid reservoir 800. Thus, the next job would result in a future job level 830 far enough below the low level 240 to require a refill operation be performed before any further job could be started. In particular, this next job will probably empty the fluid reservoir 800 before it is completed.

Of course, it is possible that this next job is so large that, even if the fluid reservoir 800 were refilled beforehand, this next job could not be completed without having to refill the fluid reservoir 800 at least once. In this case, the current remaining fluid amount 800 to the low level 240, i.e., (810 to 240) is subtracted from the needed amount of fluid 830. If that result is less than the remaining amount after refilling (220 to 240), the refill operation is delayed until the remaining amount reaches the low level 240. Otherwise, the fluid reservoir 800 is refilled immediately.

Figure 9:
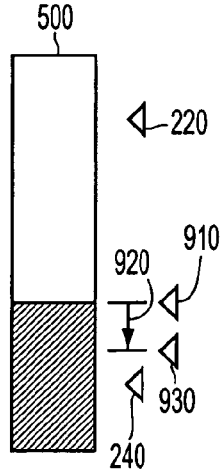

FIG. 9 shows a fluid reservoir 900 having a present fluid level 910 situated between the high level 220 and the low level 240 at the completion of the current job. A next job has a projected fluid consumption represented by a small fluid level change 920. Thus, the next job would result in a future job level 930 above the low level 240, so that a refill operation is not required.

Figure 10:
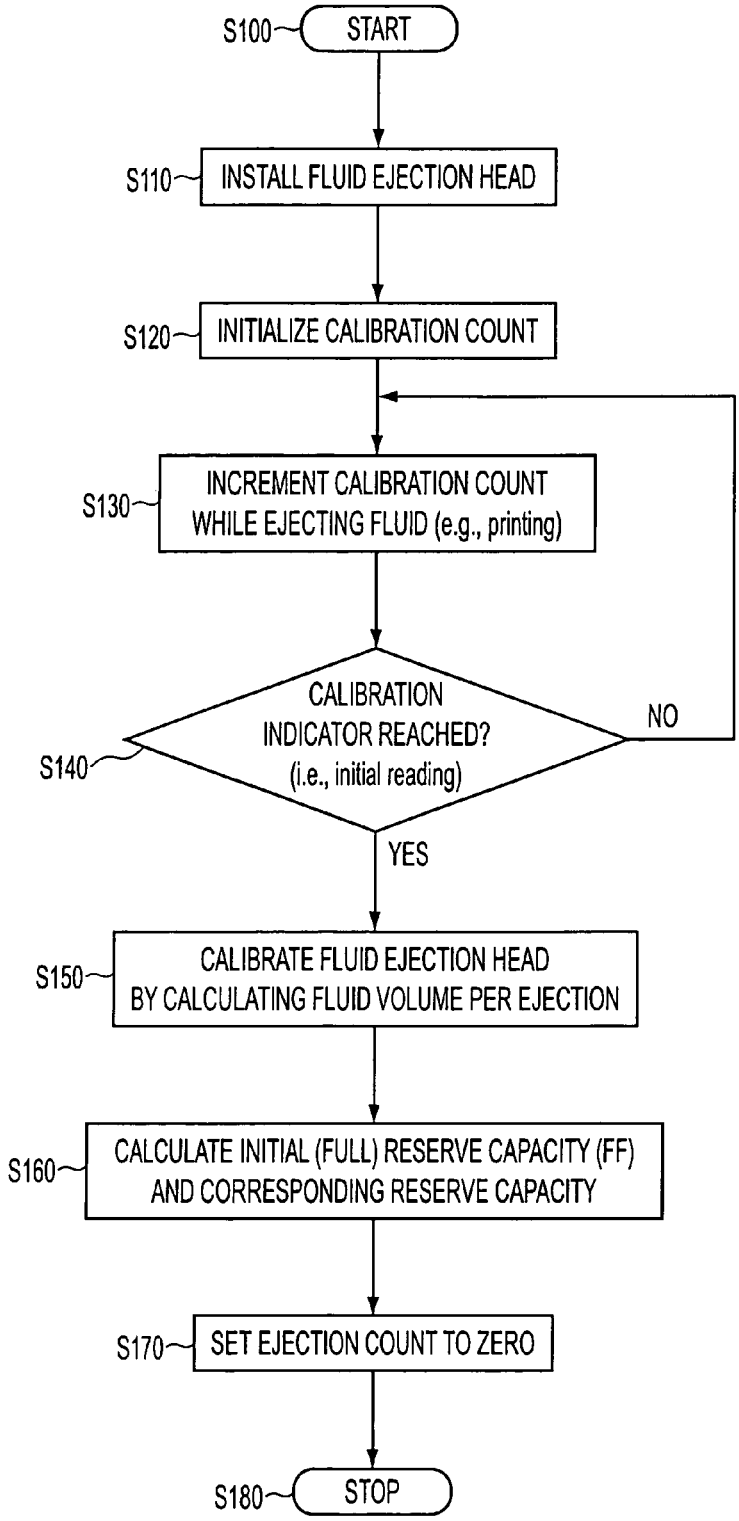
FIG. 10 is a flowchart outlining one exemplary embodiment of a method for initializing a calibration procedure in accordance with this invention.
Figure 11:
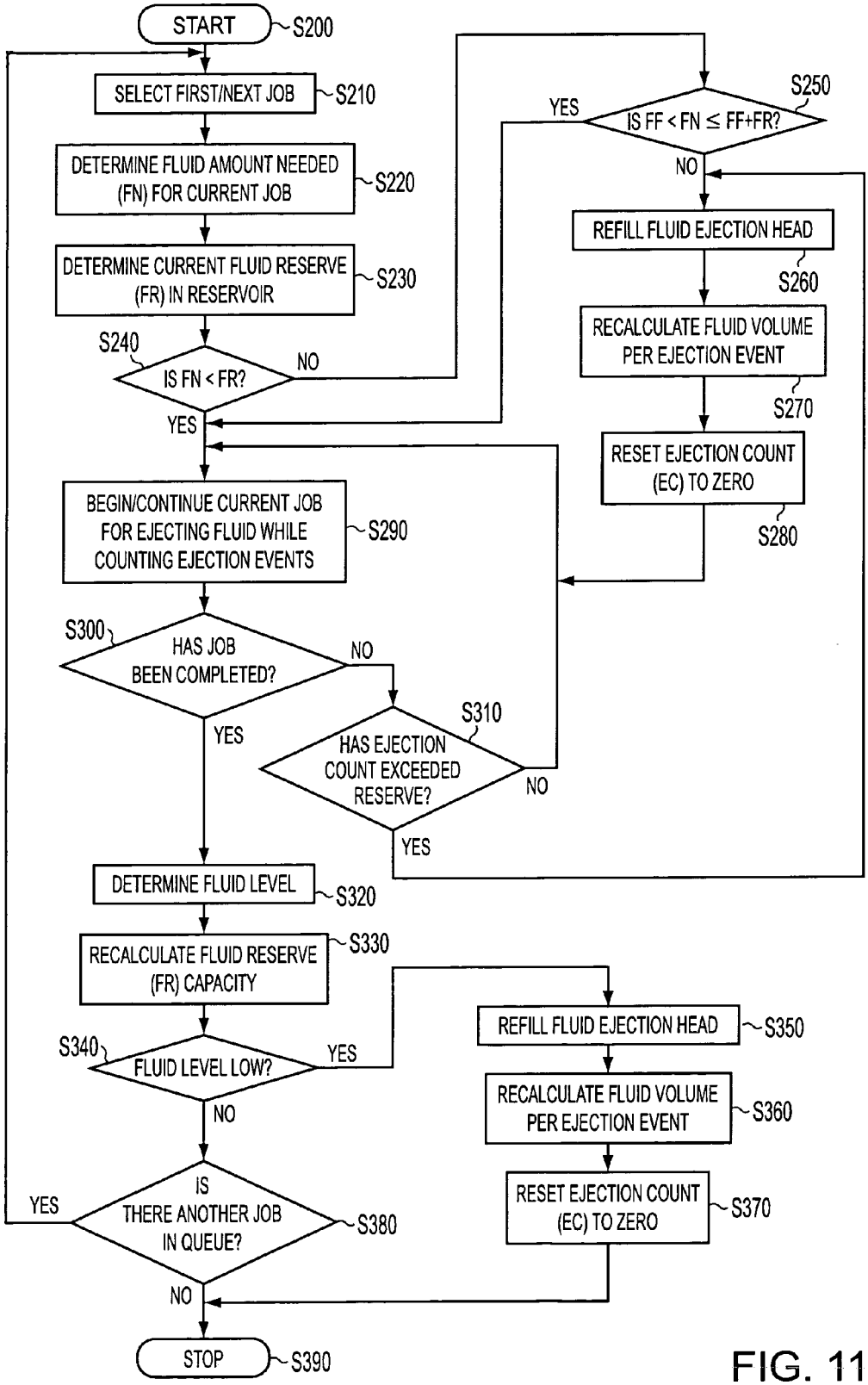
FIG. 11 is a flowchart outlining one exemplary embodiment of a method for determining a refill operation in accordance with this invention.

FIGS. 10 and 11 outline one exemplary embodiment of various methods usable when determining whether sufficient fluid (e.g., ink) remains in a fluid container (e.g., an ink reservoir) to complete an upcoming job (requiring a fluid ejection command) in a queue of such jobs that require fluid ejection (e.g., printing). FIG. 10 outlines a method for calibrating the fluid container. This calibration method can be evaluated in conjunction with the fluid reservoir 300 shown in FIG. 3.

Beginning in step S100, operation continues to step S110, where a fluid ejection head is installed. Next, in step S120, a calibration count is initialized. An initial value of the calibration count can begin at zero or any other appropriate value. Then, in step S130, the calibration count is incremented each time the fluid ejection head ejects an amount of fluid (e.g., an amount corresponding to a pixel). After expenditure of fluid, the corresponding fluid level 310 in the fluid reservoir 300 would be below the installation level 210. In various exemplary embodiments, the count can be incremented by a value of one to represent a pixel, or a value of one-thousand-twenty-four to represent a block of 1024 pixels, or at any other appropriate value, depending on how often the pixel count is to be updated in view of a stream of fluid ejection events. Operation then continues to step S140.

In step S140, a determination is made whether or not a calibration condition is satisfied. In various exemplary embodiments, a threshold prism is used to indicate whether or not the level of fluid in the fluid container has lowered in order to expose the prism to air or other appropriate ullage (vapor volume) corresponding to the high level 220. If the calibration condition is satisfied (e.g., the fluid level has reached the measured high level 220), operation continues to step S150. Otherwise, operation returns to step S130.

In step S150, the fluid ejection head is calibrated by determining the value of the fluid volume actually ejected per fluid ejection event. In various exemplary embodiments, the actual ejected fluid volume per fluid ejection event value is determined by dividing the calibration quantity of fluid (between the initial full level and the measured high level) and the calibration count (i.e., the number of pixels or fluid ejection events) to determine the actual or calibrated ejected fluid volume per fluid ejection event value. The value as installed for the quantity of fluid per ejection event can then be replaced by the more accurate actual (or calibrated) ejected fluid volume per fluid ejection event value. Next, in step S160, an initial fluid reserve capacity that is available in the fluid reservoir at this point in time, which can be defined in terms of pixel counts CR and/or in terms of amount of reserve fluid FR, is determined based on the measured high level 220 for the fluid remaining in the fluid container. Then, in step S170, the ejection count CE is set to zero. Operation then continues to step S180, where operation terminates.

It should be appreciated that steps S100 through S180 are optional and thus can be omitted. In particular, a fluid reservoir 110 without a high level 220 or without need of adjusting the installed value for the quantity of ejected fluid per ejection event may not need to have steps S100–S180 performed.

FIG. 11 outlines one exemplary embodiment of a method for determining the current reserve fluid capacity in a fluid container. This method can be evaluated in conjunction with the fluid reservoirs shown in FIGS. 4–9. Beginning in step S200, and, in various exemplary embodiments, after using the calibration method outlined in FIG. 10, operation continues to step S210, where the first or next fluid ejection job is selected as the current job. Next, in step S220, the fluid amount (FN) needed to complete the current job by fluid ejection is determined. Then, in step S230, the current fluid reserve amount (FR) in the reservoir is determined. Operation then continues to step S240.

In step S240, a determination is made whether the needed amount of fluid (FN) is less than the current fluid reservoir amount (FR). If so, operation jumps to step S290. Otherwise, operation continues to step S250. In step S250, a determination is made whether the needed amount of fluid (FN) is greater than the reservoir filled amount (FF) and is less than or equal to the reservoir filled amount plus the current fluid reservoir (FF+FR). That is, in step S250, the needed amount of fluid (FN) is analyzed to determine if the fluid reservoir will need to be refilled at least once even if it were to be refilled before this job is begun. If so, the needed amount of fluid (FN) is further analyzed to determine if the job is partially completed to the point where the current fluid reservoir amount is consumed, whether the remaining needed amount of fluid (FN−FR) is less than the reservoir filled amount. If so, the refill operation can be delayed until that point, such that only one refill operation will be required to complete this current job. Otherwise, the current job would need to be delayed before it is begun to initially refill the fluid reservoir, and then would still need to be halted before it is completed to again refill the fluid reservoir. Of course, if the needed amount of fluid (FN) is greater than the current fluid reservoir (FF+FR), two refill operations will be needed in any case, so the fluid reservoir is, in this exemplary embodiment, refilled immediately rather than later. If so, operation jumps to step S290. Otherwise, operation continues to step S260.

In step S260, the fluid ejection head is refilled. Next, in step S270, the fluid volume per ejection event is recalculated. Then, in step S280, the ejection count (CE) is reset to zero or otherwise reinitialized. Operation then continues to step S290.

In step S290, the ejection count (CE) is incremented while the fluid ejection head ejects fluid as commanded (e.g., to print an image) during a current ejection job. Then, in step S300, a determination is made whether the current job has been completed. If so, operation jumps to step S320. Otherwise, operation continues to step S310, where a determination is made whether the ejection count indicates that the amount of fluid remaining in the fluid reservoir has fallen below the fluid reserve amount (FR). If not, operation returns to step S290. Otherwise, operation jumps to step S260.

In step S320, the fluid level is determined. Next, in step S330, the fluid reserve capacity (FR) is recalculated. Then, in step S340, a determination is made whether the fluid level is low. If not, operation jumps to step S380. Otherwise, operation continues to step S350, where the fluid ejection head is refilled. Next, in step S360, the fluid volume per ejection event is recalculated. Then, in step S370, the ejection count (CE) is reset to zero or otherwise reinitialized. Operation then continues to step S380.

In step S380, a determination is made whether another job is in the queue. If so, operation returns to step S210. Otherwise, operation continues to step S390, where operation of the method terminates.

Figure 12:
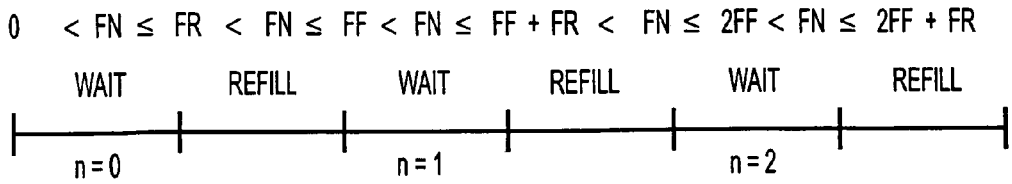
FIG. 12 illustrates one exemplary embodiment of a sequence of refilling a fluid reservoir refilling system in accordance with this invention.

FIG. 12 shows a generalization of step S250 for any number of refill operations, and any needed amount of fluid (FN), indicating whether the fluid reservoir should be refilled before the current job is begun or whether refilling should be delayed until the current fluid reservoir amount (FR) is depleted. In FIG. 12, n represents a number of full reservoirs. As shown in FIG. 12, to minimize the number of refill operations, the fluid reservoir should be immediately refilled if the needed amount of fluid (FN) for the current job is greater than [(n−1)FF+FR] but is less than or equal to (n FF). In contrast, the fluid reservoir should be refilled only after depleting the current fluid reservoir amount (FR) if the needed amount of fluid (FN) is greater than (n FF) but is less than or equal to (n FF+FR). That is:

$$(n-1)FF+FR<FN\leqq nFF\text{: refill immediately}$$

$$nFF<FN\leqq nFF+FR\text{: delay refill}$$

Figure 13:
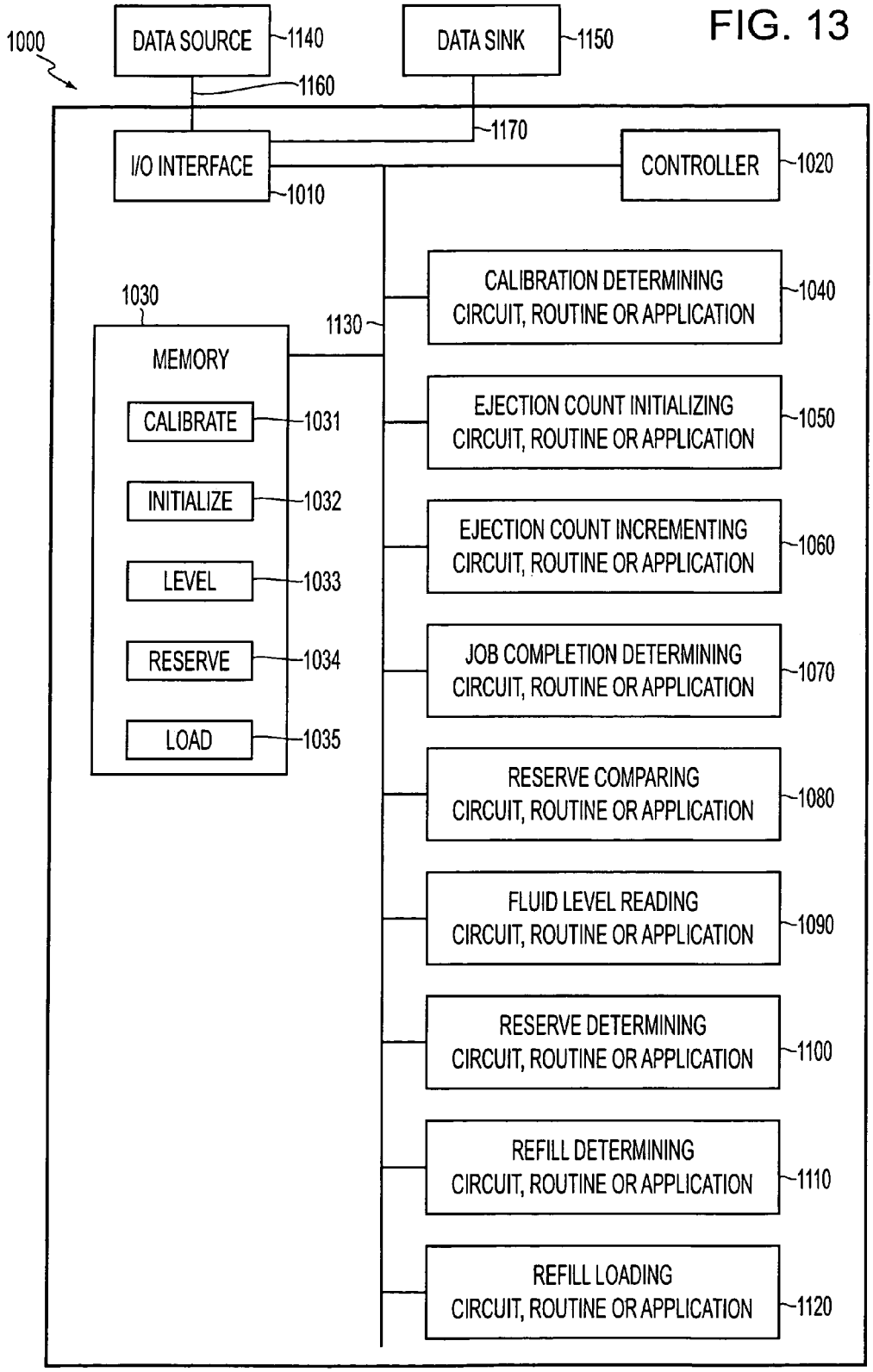
FIG. 13 is a block diagram of one exemplary embodiment of refilling a fluid reservoir refilling system according to this invention.

FIG. 13 is a block diagram outlining one exemplary embodiment of a fluid reservoir refilling system 1000 according to this invention. As shown in FIG. 13, the fluid reservoir refilling system 1000 includes one or more of an input/output (I/O) interface 1010, a controller 1020, a memory 1030, a calibration determining circuit, routine or application 1040, an ejection count initializing circuit, routine or application 1050, an ejection count incrementing circuit, routine or application 1060, a job completion determining circuit, routine or application 1070, a reserve comparing circuit, routine or application 1080, a fluid level reading circuit, routine or application 1090, a reserve capacity determining circuit, routine or application 1100, a refill condition determining circuit, routine or application 1110, and/or a refill loading circuit routine or application 1120, appropriately connected by one or more control and/or data busses and/or one or more application programming interfaces 1130.

It should be appreciated that the fluid reservoir refilling system 1000 will typically be a subsystem of, or otherwise a portion of, a larger fluid ejection system. However, for ease of illustration and explanation, the other portions of that larger fluid ejection system, such as the fluid ejector head, the refilling station, the fluid ejection control elements and the like, with which the fluid reservoir refilling system 1000, shown in FIG. 13, would normally interact, have been omitted.

The input/output interface 1010 interacts with the outside of the fluid reservoir refilling system 1000. For example, if the fluid reservoir refilling system 1000 is embedded in a printer, the input/output interface 1010 receives an image from an image data source 1140 over a link 1160. The input/output interface 1010 may also output data about the fluid reservoir refilling system 1000 to a data sink 1150 over a link 1170. The input/output interface 1010 may also be connected to one or more user input devices and/or one or more output devices, or the like.

In various exemplary embodiments, the data source 1140 can be integrated with the fluid reservoir refilling system 1000, such as in a printer having an integrated image receiver, such as a scanner or facsimile machine. In various other exemplary embodiments, the image data source 1140 can be connected to the input/output interface 1010 over the link 1160, which can be implemented using any appropriate connection device, such as a direct wiring or cable connection, a modem, a local area network, a wide area network, an intranet, the Internet, and any other distributed processing network, or any other known or later-developed connection structure.

The image data source 1140 can be any known or later-developed source that is capable of supplying data to the input/output interface 1010 of the fluid reservoir refilling system 1000. For example, the image data source 1140 may be a data carrier such as a magnetic storage disk, CD-ROM or the like, or a host computer that contains scanned image data. Thus, the image data source 1140 can be any known or later-developed source that is capable of providing image data to the fluid reservoir refilling system 1000 according to this invention.

The data sink 1150 can be any known or later-developed device that is capable of receiving data output by the fluid reservoir refilling system 1000 and either storing, transmitting or displaying such data. In various exemplary embodiments, the data sink 1150 can be connected to the input/output interface 1010 over a link 1170. The link 1170 can be implemented using any appropriate connection device such as a direct connection, a modem, a local area network, a wide area network, an intranet, the Internet, and any other distributed processing network, or any other known or later-developed connection device.

The memory 1030 stores information received from the input/output interface 1010, such as ejection data received at the input/output interface 1010. The memory 1030 also stores information and/or data from various ones of the circuits, routines or applications 1040–1120 of the fluid reservoir refilling system 1000. The memory 1030 can be implemented using any appropriate combination of alterable, volatile or non-volatile memory or non-alterable or fixed, memory. The alterable memory, whether volatile or non-volatile, can be implemented using any one or more of static or dynamic RAM, a floppy disk and disk drive, a writeable or re-writeable optical disk and disk drive, a hard drive, flash memory or the like. Similarly, the non-alterable or fixed memory 1030 can be implemented using any one or more of ROM, PROM, EPROM, EEPROM, an optical ROM, such as a CD-ROM or DVD-ROM disk and disk drive or the like.

As shown in FIG. 13, the memory 1030 includes one or more of a calibration determining portion 1031, which stores the calibration data; an ejection count data portion 1032, which stores the ejection count data; a read fluid level portion 1033, which stores the read fluid level in the fluid reservoir; a reserve capacity data portion 1034, which stores the reserve capacity data; and/or a refill data portion 1035, which stores data representing an amount of fluid stored in the reservoir upon being refilled in either volume and/or ejection events.

The one or more control and/or data busses and/or application programming interfaces 1130 provide communication and data transfer among the input/output interface 1010, the controller 1020, the memory 1030 and/or various ones of the circuits, routines or applications 1040–1120 of the fluid reservoir refilling system 1000. The controller 1020 provides instructions and/or control signals to various ones of the circuit, routine or application 1040–1120 of the fluid reservoir refilling system 1000.

The calibration determining circuit, routine or application 1040 determines an amount of fluid ejected for the fluid ejection head per fluid ejection event based on the calibration measurements. The ejection count data circuit, routine or application 1050 initializes one or more ejection or other counts corresponding to fluid ejection commands in various exemplary embodiments. The ejection count incrementing circuit, routine or application 1060 adjusts the one or more ejection or other counts as fluid is ejected from the reservoir based on the number of fluid ejection events. The job completion determining circuit, routine or application 1070 determines whether the current job has been completed.

The reserve comparing circuit, routine or application 1080 compares the amount of fluid, in counts or in volume, needed to complete the current job to the reserve amount and/or to the refilled reservoir amount, and/or some combination of these values as indicated in FIG. 11. The fluid level reading circuit, routine or application 1090 reads or otherwise determines the fluid level based on the fluid level sensors. The reserve capacity determining circuit, routine or application 1100 determines the reserve fluid capacity in the fluid container based on the read fluid level and the value of the fluid amount per fluid ejection event. The refill condition determining circuit, routine or application 1110 determines, based on the results from the fluid level reading circuit, routine or application 1090 and/or from the reserve comparing circuit, routine or application 1100, whether one or more refill conditions have been met, such that the fluid reservoir should be refilled. The refill loading circuit, routine or application 1120 operates the fluid ejection head and/or the refill device to refill the fluid ejection head.

The fluid reservoir refilling system 1000 is, in various exemplary embodiments, implemented using a programmed general purpose computer. However, the fluid reservoir refilling system 1000 can also be implemented on a special purpose computer, a programmed microprocessor or microcontroller and peripheral integrated circuits, an ASIC or other integrated circuit, a digital signal processor, a hard wired electronic or logic circuit such as a discrete element circuit, a programmable logic device such as a PLD, PLA, FPGA or PAL, or the like. In general, any device, capable of implementing a finite state machine that is in turn capable of implementing one or more of the flowcharts shown in FIGS. 10 and 11, can be used to implement the fluid reservoir refilling system 1000.

It should be understood that each of the circuits, routines and/or applications shown in FIG. 13 can be implemented as physically distinct hardware circuits within an ASIC, or using an FPGA, a PDL, a PLA or a PAL, a digital signal processor, or using discrete logic elements or discrete circuit elements. The particular form each of the circuits or routines shown in FIG. 13 will take is a design choice and will be obvious and predictable to those skilled in the art.

The fluid reservoir refilling system 1000 can be a plurality of separate dedicated or programmable integrated or other electronic circuits or devices or implemented using a suitably programmed general purpose computer, either alone or in conjunction with one or more peripheral data and signal processing devices. In general, any device or assembly of devices on which a finite state machine capable of implementing the procedures described herein can be used as the fluid reservoir refilling system 1000. A distributed processing architecture can be used for maximum data/signal processing capability and speed.

While this invention has been described in conjunction with exemplary embodiments outlined above, many alternatives, modifications and variations will be apparent to those skilled in the art. Accordingly, the exemplary embodiments of the invention, as set forth above, are intended to be illustrative, not limiting. Various changes can be made without departing from the spirit and scope of the invention.

What is claimed is:

1. A method for controllably refilling a fluid ejector having a refillable container usable to contain fluid, the fluid ejector ejecting fluid from the refillable container in response to ejection data contained in an ejection job, the method comprising:

determining a first number of fluid ejection events remaining in the refillable container until the refillable container is to be refilled;

determining a second number of fluid ejection events needed to complete the ejection job;

refilling the refillable container if either a first condition or a second condition is satisfied; and calibrating a fluid quantity corresponding to a fluid ejection event based on a third number of fluid ejection events between the refillable container being filled and the refillable container when the either of the first or second condition is satisfied, wherein:

the first condition is satisfied when the determined second number of fluid ejection events is greater than the determined first number of fluid ejection events, and the second condition is satisfied when the first number of fluid ejection events is at most zero.

2. The method according to claim 1, wherein determining the first number of fluid ejection events comprises comparing a fluid reserve capacity to an indicated fluid level.

3. The method according to claim 2, wherein comparing the fluid reserve capacity to the indicated fluid level comprises comparing the fluid reserve capacity to a refill threshold level.

4. The method according to claim 1, wherein determining the first number of fluid ejection events bases each fluid ejection event on a single ejection from the fluid ejector.

5. The method according to claim 1, wherein determining the first number of fluid ejection events comprises bases each fluid ejection event on a particular number of single ejections from the fluid ejector.

6. A method for controllably refilling a fluid ejector having a refillable container usable to contain fluid, the fluid ejector ejecting fluid from the refillable container in response to ejection data contained in an ejection job, the method comprising:

determining a first number of fluid ejection events remaining in the refillable container until the refillable container is to be refilled;

determining a second number of fluid ejection events needed to complete the ejection job; and refilling the refillable container if either a first condition or a second condition is satisfied, wherein:

the first condition is satisfied when the determined second number of fluid ejection events is greater than the determined first number of fluid ejection events, the second condition is satisfied when the first number of fluid ejection events is at most zero, and refilling the refillable container comprises delaying refilling the refillable container if the first condition is satisfied, until the second condition is satisfied when the second number of fluid ejection events is greater than a third number of fluid ejector events that are available after refilling the refillable container, and is less than or equal to a sum of the first number of fluid ejection events and the third number of fluid ejection events.

7. A method for controllably refilling a fluid ejector having a refillable container usable to contain fluid, the fluid ejector ejecting fluid from the refillable container in response to ejection data contained in an ejection job, the method comprising:

determining a first number of fluid ejection events remaining in the refillable container until the refillable container is to be refilled;

determining a second number of fluid ejection events needed to complete the ejection job; and refilling the refillable container if either a first condition or a second condition is satisfied, wherein:

the first condition is satisfied when the determined second number of fluid ejection events is greater than the determined first number of fluid ejection events, the second condition is satisfied when the first number of fluid ejection events is at most zero, and determining the first number of fluid ejection events comprises initializing a reserve capacity count.

8. The method according to claim 7, wherein determining the first number of fluid ejection events further comprises updating the reserve capacity count in response to a specific amount of fluid being ejected from the container.

9. A method for controllably refilling a fluid ejector having a refillable container usable to contain fluid, the fluid ejector ejecting fluid from the refillable container in response to ejection data contained in an ejection job, the method comprising:

determining a first number of fluid ejection events remaining in the refillable container until the refillable container is to be refilled;

determining a second number of fluid ejection events needed to complete the ejection job; and refilling the refillable container if either a first condition or a second condition is satisfied, wherein:

the first condition is satisfied when the determined second number of fluid ejection events is greater than the determined first number of fluid ejection events, the second condition is satisfied when the first number of fluid ejection events is at most zero, determining the first number of fluid ejection events comprises comparing a fluid reserve capacity to an indicated fluid level, and comparing the fluid reserve capacity to the indicated fluid level comprises comparing the fluid reserve capacity to a full level.

10. A method for controllably refilling a fluid ejector having a refillable container usable to contain fluid, the fluid ejector ejecting fluid from the refillable container in response to ejection data contained in an ejection job, the method comprising:

determining a first number of fluid ejection events remaining in the refillable container until the refillable container is to be refilled;

determining a second number of fluid ejection events needed to complete the ejection job; and refilling the refillable container if either a first condition or a second condition is satisfied, wherein:

the first condition is satisfied when the determined second number of fluid ejection events is greater than the determined first number of fluid ejection events, the second condition is satisfied when the first number of fluid ejection events is at most zero, and refilling the refillable container comprises:

determining if $$(n-1)FF+FR<FN\leqq n\ FF,$$

where

FF is a filled reservoir amount of fluid;

FR is a current reservoir amount of fluid;

FN is an estimated amount of fluid needed to complete the ejection job;

n is an integer greater than zero;

if the equation is satisfied, delaying refilling the reservoir until both the first and second condition are satisfied; and if the equation is not satisfied, refilling the reservoir if the first condition is satisfied.

11. A fluid refill control system of a fluid ejector having a refillable reservoir usable to contain fluid, comprising:

a fluid ejection amount determining circuit, routine or application that determines an expended quantity of fluid released from the container in response to an occurrence of a number of fluid ejection events;

a fluid reserve determining circuit, routine or application that determines a fluid reserve capacity and a fluid job requirement; and a refill condition determining circuit, routine or application that determines that the container is to be refilled upon at least one of a first condition where the fluid job requirement exceeds the fluid reserve capacity and a second condition, where the fluid reserve capacity is below a refill threshold, has been satisfied; and a calibrating determining circuit, routine or application that calibrates a fluid quantity corresponding to a fluid ejection event based on a total number of fluid ejection events between the refillable container being filled and the refillable container when the either of the first or second condition is satisfied.

12. The system according to claim 11, further comprising:

a count initializing circuit, routine or application that initializes at least one of an ejection event count and a reserve capacity count; and a count incrementing circuit, routine or application that adjusts at least one of the ejection event count and the reserve capacity count in response to a specific amount of fluid being ejected from the container.

13. The system according to claim 11, further comprising:

a fluid level indicating circuit, routine or application that is usable with at least one fluid level indicator to determine at least one fluid level in the container.

14. The system according to claim 11, wherein the fluid reserve determining circuit, routine or application comprises:

a reserve capacity determining circuit, routine or application that determines a fluid reserve capacity in the container based on the reserve capacity count and the expended quantity of fluid;

a fluid job requirement circuit, routine or application that determines a fluid amount required to complete a current job based on the expended quantity of fluid and a number of fluid ejection events for the job; and a reserve comparing circuit, routine or application that compares the fluid reserve capacity and the fluid job requirement.

15. A fluid refill control system of a fluid ejector having a refillable reservoir usable to contain fluid, comprising:

a fluid ejection amount determining circuit, routine or application that determines an expended quantity of fluid released from the container in response to an occurrence of a number of fluid ejection events;

a fluid reserve determining circuit, routine or application that determines a fluid reserve capacity and a fluid job requirement; and a refill condition determining circuit, routine or application that determines that the container is to be refilled upon at least one of a first condition where the fluid job requirement exceeds the fluid reserve capacity and a second condition, where the fluid reserve capacity is below a refill threshold, has been satisfied, wherein the refill condition determining circuit, routine or application further determines if $$(n-1)FF+FR<FN\leqq n\ FF,$$

where

FF is a filled reservoir amount of fluid;

FR is a current reservoir amount of fluid;

FN is an estimated amount of fluid needed to complete the ejection job;

n is an integer greater than zero;

if the equation is satisfied, delaying refilling the reservoir until both the first and second condition are satisfied; and if the equation is not satisfied, refilling the reservoir if the first condition is satisfied.

* * * * *